United States Patent [19]

Norman et al.

[11] Patent Number: 4,915,297

[45] Date of Patent: Apr. 10, 1990

[54] LIQUID HEATING SYSTEM FOR CONCRETE PLANTS

[75] Inventors: Robert D. Norman, Research; Robert G. Sinclair, Eltham, both of Australia

[73] Assignee: Heat-Crete, Pty. Ltd., Victoria, Australia

[21] Appl. No.: 231,504

[22] Filed: Aug. 12, 1988

[30] Foreign Application Priority Data

Aug. 13, 1987 [AU] Australia ..... PI3762

[51] Int. Cl.[4] ..... F24D 3/00

[52] U.S. Cl. ..... 237/8 A; 122/20 A

[58] Field of Search ..... 237/8 R, 8 A; 122/20 A, 122/20 B, 406 R, 32, 13 R

[56] References Cited

U.S. PATENT DOCUMENTS

| | | | |
|---|---|---|---|
| 2,227,349 | 12/1940 | Kerrick | 237/8 R |
| 2,613,653 | 10/1952 | Wald | 122/20 A |
| 3,254,839 | 6/1966 | McClanahan et al. | 237/8 R |
| 4,143,814 | 3/1979 | Hill, Jr. | 237/8 R |
| 4,516,720 | 5/1985 | Chaplin | 237/8 R |

*Primary Examiner*—Edward G. Favors
*Attorney, Agent, or Firm*—Foley & Lardner

[57] ABSTRACT

A water heating system for a concrete batching plant comprising a closed tank (1) having low heat transfer properties for containing the liquid to be heated, a heat exchanger having liquid carrying conduit means connected by conduits (2,3) to said tank (1), a first pump (3*a*) for circulating liquid from the tank (1) to the heat exchanger (4) while the liquid is being heated by said heat exchanger (4), a second pump for transferring the heating liquid from said tank to the concrete batching plant, control means for controlling the operation of said heat exchanger and said pumps and including means for monitoring the ambient temperature, the temperature of the water in the tank, the temperature of the water delivered from the tank, and the amount of water delivered from the tank, and a mixing valve for mixing cold water and/or recycled water with said heated water, said control means controlling the positioning of said mixing valve based on the temperature of the water in the tank and the temperature of the water required to be delivered to the batching plant.

9 Claims, 8 Drawing Sheets

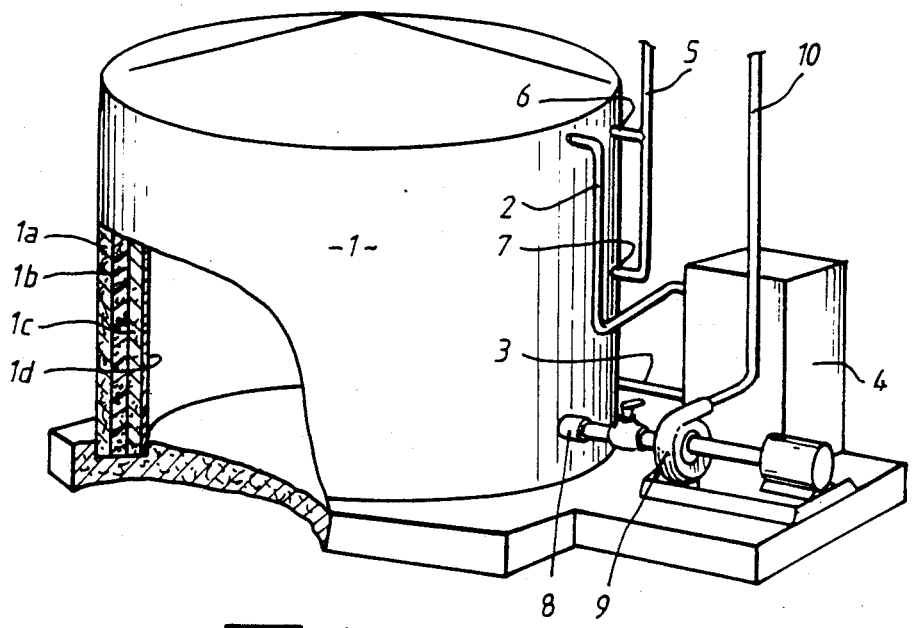
FIG. 1.
FIG. 2.
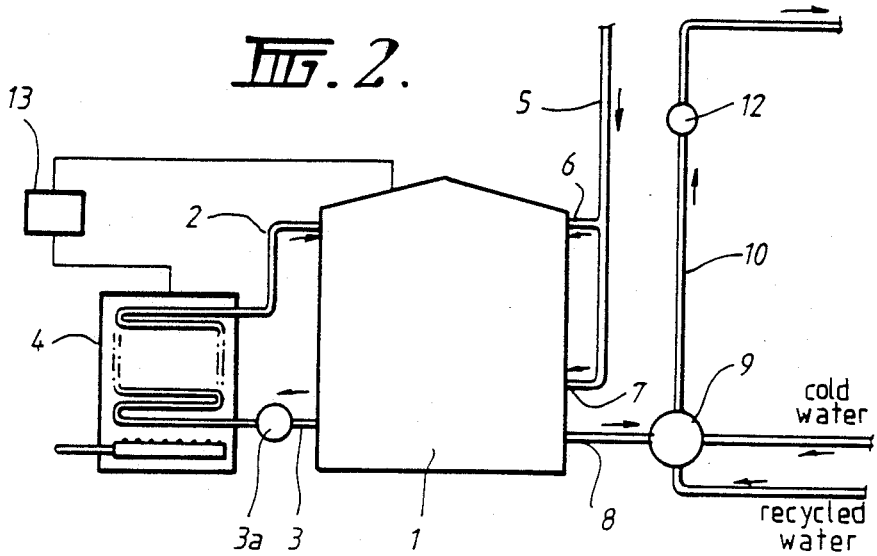

TEST KEPT AT 8°c

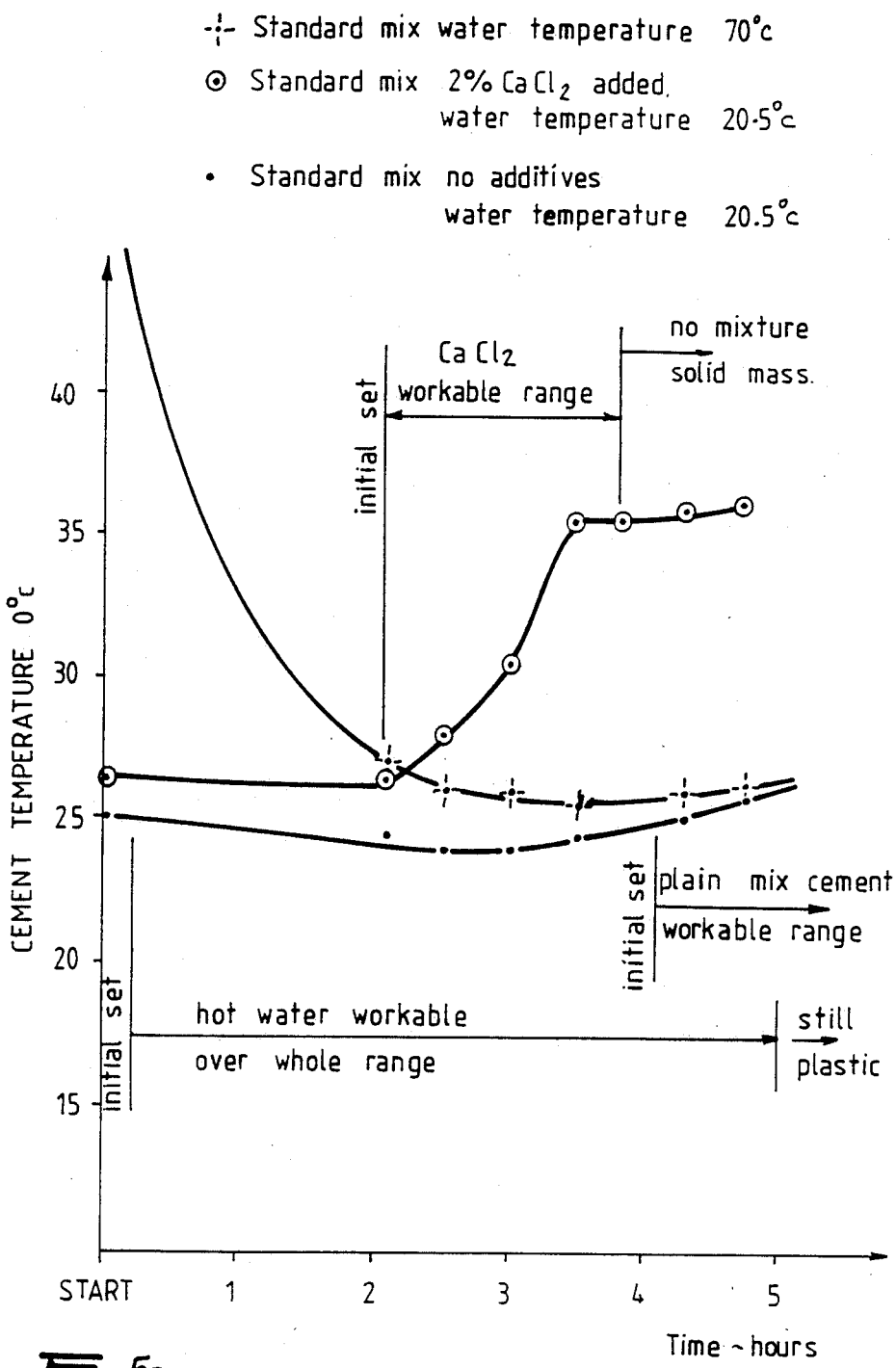
FIG. 5B. TEST AT AMBIENT OAT Approx 22°c

LIQUID HEATING SYSTEM FOR CONCRETE PLANTS

FIELD OF THE INVENTION:

This invention relates to an improved system for heating large volumes of liquid, such as water, in an economical manner for use in concrete batching plants.

BACKGROUND OF THE INVENTION:

The heating of large volumes of water is presently extremely costly, both in terms of the capital cost of the equipment involved, and in terms of the energy costs involved in the heating process.

It has been known in the past to use hot water in the preparation of concrete mixer to act as a trigger in the curing process whereby the curing time is substantially reduced. Since the introduction of chemical accelerators, the use of hot water has been virtually eliminated. However, chemical accelerators are becoming increasingly expensive and their use tends to promote the formation of rust in the reinforcing steel used with the concrete. In fact, the use of calcium chloride above a level of about 0.8%, which is not particularly effective, was recently banned in Australia for this reason. While other curing accelerators are available for use, they are even more expensive than calcium chloride.

The major obstacle preventing a return to the use of hot water to accelerate the concrete curing has been the capital cost and energy cost of heating the water. It will be appreciated that a large volume of water must be heated to satisfy the requirements of a typical concrete batching plant, and since a large heat exchanger must be used to bring the large volume of water to the required temperature over a long period of time, it has not in the past been economically viable to reintroduce the use of hot water for this purpose.

SUMMARY OF THE INVENTION AND OBJECTS:

It is an object of the present invention to provide a more economical system by means of which water and other liquids may be heated in large volumes for use in concrete batching plants.

According to the invention, there is provided a liquid heating system for use in concrete batching plants, comprising a closed tank having low heat transfer properties for containing a volume of liquid to be heated, a heat exchanger having liquid carrying conduit means connected by liquid carrying conduits to said tank, and first pump means for transferring the heated liquid from the tank for use in the concrete batching plant, characterised by the second pump means for circulating the liquid from the tank to the heat exchanger while the liquid is being heated by said heat exchanger and by the capacity of said tank and the heating capacity of said heat exchanger being selected to enable the production of the desired volume of hot liquid required by the batching plant.

By using the above defined system, it has been found that the same volume of liquid, such as water, can be heated using a far smaller heat exchanger than is required in a static liquid heating system. This reduces the capital cost involved in the heating system and makes the use of hot water as a curing accelerator in the manufacture of concrete at a batching plant more economically viable. The cost of heating water for this purpose has been found to be as low as twenty cents per cubic meter which is most competitive when compared with chemical accelerator costs. In addition, the use of hot water removes the rust acceleration problem associated with the use of chemical accelerators.

BRIEF DESCRIPTION OF THE DRAWINGS:

One presently preferred form of the invention will now be described with reference to the accompanying drawings in which:

FIG. 1 is a perspective view of a typical liquid heating system embodying the invention, in which the liquid storage tank is shown partly in section.

FIG. 2 is a schematic block diagram of the liquid heating system embodying the invention;

FIG. 5B shows similar comparative graphs at an ambient temperature of approximately 22° C.;

Figure 1A:
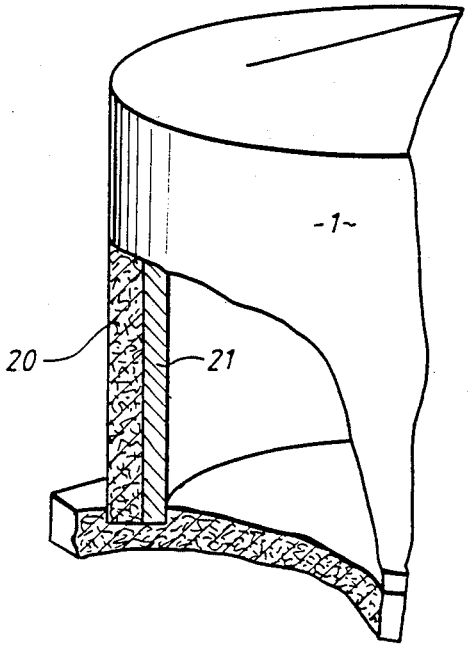
FIGS. 1A–1C are fragmentary sectional views of modified liquid storage tanks.
Figure 1B:
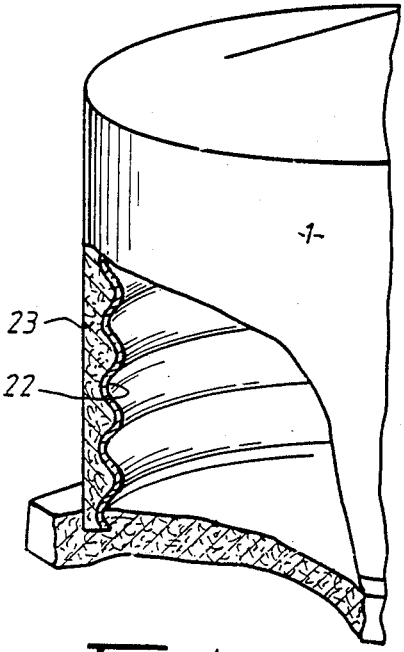
Figure 1C:
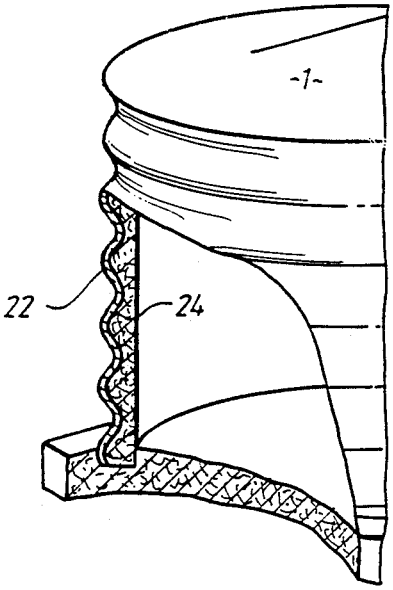

DESCRIPTION OF PREFERRED EMBODIMENT:

Referring to the FIGS. 1 and 2 of the drawings, the water heating system embodying the invention comprises a closed concrete water tank 1, which either has thicker walls than the usual concrete water tank, or is of a composite construction as shown in FIG. 1, including an outer skin 1*a* of concrete, an inner layer of polyurethane foam insulation 1*b* and an inner skin of concrete 1*c* coated with a layer 1*d* of suitable waterproofing material. Less expensive alternatives to this structure comprise a standard concrete tank 20 with a vermiculite and cement mixture 21 sprayed onto the inside surface of the tank to a depth of about 50mm or a corrugated iron tank 22 sprayed with a vermiculite and cement mixture 23 or 24 on either side of the tank 22 to a total depth of about 75 mm.

Figure 3:
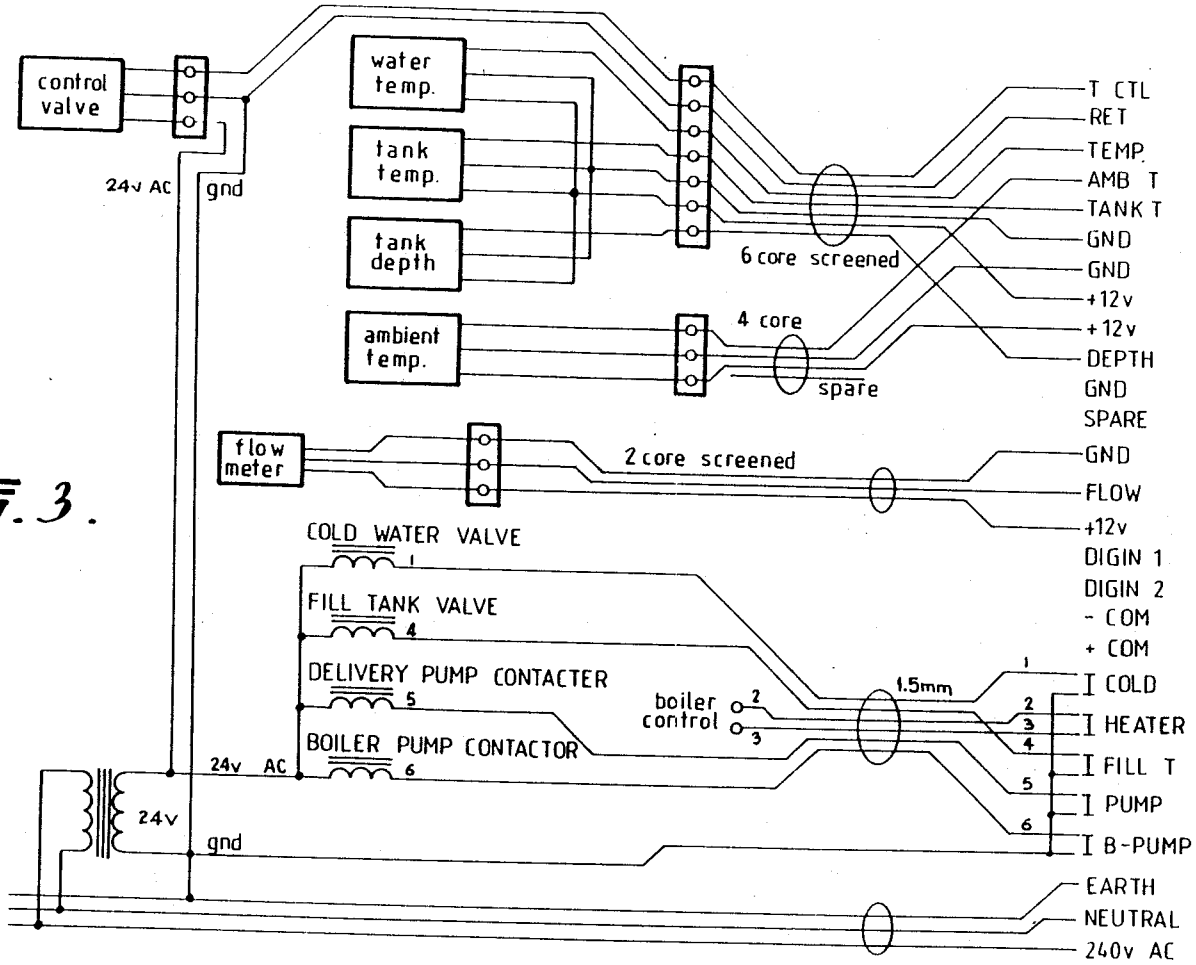
FIG. 3 is a schematic representation of the wiring diagram of the control system for the lqiuid heating system.

The tank 1 is connected by conduits 2 and 3 to a pump 3*a* (FIG. 2) which circulates the water in the tank 1 through a heat exchanger or boiler 4 to heat the water contained in the tank to a desired temperature. The heat exchanger 4 is a typical heat exchanger, and as shown in FIG. 2, and comprises gas jets and copper coils connected to the conduits 2 and 3. Cold water is introduced into the tank 1 via a conduit 5 at two points 6 and 7, so that either half a tank or a full tank of water may be heated. The introduction of water is controlled by a standard control valve ("fill tank valve" FIG. 3) and an outlet pipe 8 is connected to a pump 9 which delivers hot water from the tank 1 via an insulated conduit 10 to a concrete batching hopper (not shown). As shown in FIGS. 2 and 3, cold water or recycled water may be added to the hot water from the pump 9 under the control of a mixing valve ("control valve" FIG. 3).

In the above described embodiment, the tank 1 holds about 22,700 liters of water, and this has been found to be a suitable volume for a typical medium-sized concrete batching plant having an output of about 200 cubic meters per day. The circulating pump 3*a* may comprise a 100 gpm Grunfos UMC/6560 pump while the delivery pump 9 is preferably a Grunfos 4KW 12.5 l/sec with a 20 metre head. One of the requirements for a concrete batching plant is that the mixing truck must be filled in approximately two minutes so that the delivery rate required is at least eight liters per second. The heat exchanger is preferably a 929 MJ gas heater of any suitable design. Numerous commercially available heat exchangers may be used, such as those manufactured under the names Ray-Pak and Teledez. The hot water delivery line 10 may be made from ABS plastic to reduce heat losses and to provide the necessary strength or a suitably insulated copper conduit may be used.

The delivery line 10 includes a flow meter 12 of any suitable type by means of which the volume of liquid being delivered to the batching plant may be monitored or recorded. The heat exchanger is operated under the control of a computer 13 to enable the heat exchanger to operate automatically to commence heating the water at any predetermined time, and to enable delivery of heated water at the required temperature. If desired, a manual override may be provided to allow manual operation at any time.

Figure 4:
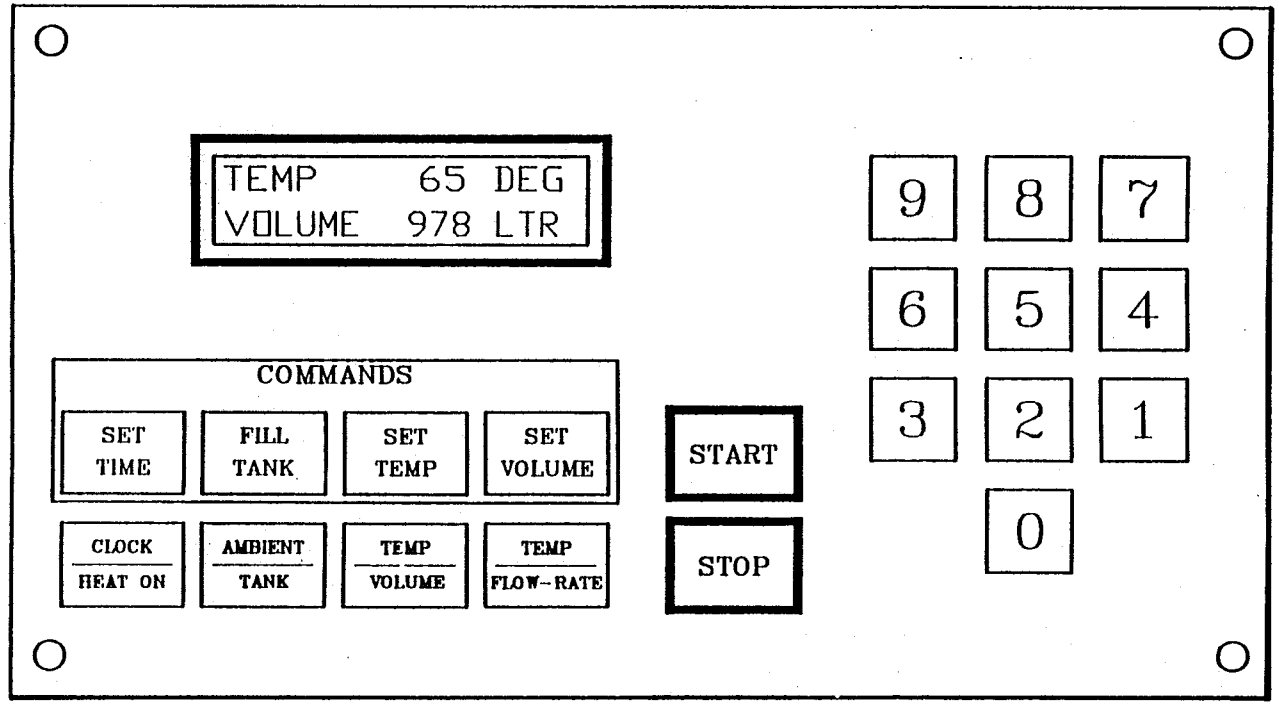
FIG. 4 is a front view of the control panel of the liquid heating system.

Referring now to FIGS. 3 and 4 of the drawings, the control system circuitry for the water heating system provides electrical connections to the mixing valve or water control valve, and includes means for monitoring the temperature of the water delivered from the tank ("water temp"), the temperature of the water in the tank ("tank temp"), the depth of the water in the tank, the ambient temperature and the output of flow meter 12, by means of which the volume of water delivered from the tank by the pump 9 is known. The circulating pump 3*a* ("boiler pump contactor"), the delivery pump 9 ("delivery pump contactor"), the valve controlling filling of the tank ("cold water valve"), the heat exchanger or boiler operation ("boiler control") and the mixing valve ("control valve") controlling the introduction of cold water to the water delivered from the tank 1 to adjust its temperature are actuated by the solenoid means shown in FIG. 3 under the control of the control system computer.

The computer 13 has its operating program altered by the operator from the control panel of FIG. 4. The control panel has a two line 16 character legend crystal display which allows the display of water flow rate, volume of water delivered to the truck, the temperature of the delivered water, the temperature and volume of water in the hot water storage tank and the ambient air temperature by the actuation of the labelled display keys. Commands may be entered into the computer via the four command buttons shown in FIG. 4 using the key pad to set the time of commencement of heating, the filling of the tank, the temperature of the water to be achieved and the volume of water to be heated.

The computer controls the mixing valve ("control-valve" FIG. 3) according to a look-up table containing data relating to tank temperature, required water temperature, water temperature and the mixing valve positions required to achieve a required water temperature to set the valve at approximately the correct position prior to starting the pump 9. The water temperature monitor then controls the mixing valve to achieve the desired temperature.

To estimate the required water temperature, the operator notes the ambient temperature from the control panel display, and follows the temperature curve to the point of intersection with the vertical axis corresponding to the amount of cement in the mix. This point is then projected horizontally to the reference line and the closest curve is followed to the point of intersection with the desired slump line, and the temperature is then selected from the right vertical axis. For example for an ambient temperature of 10° C., a cement control of 250 $Kg/m^3$ and a desired slump of 70mm, the necessary temperature is 50° C.

All programming switches have a tactile feel and together with the LCD display are mounted behind a washable plastic membrane. The computer used to control the system may comprise any suitable programmable microprocessor or may comprise a special purpose programmable microprocessor chip of any suitable type.

It will be appreciated from the above that the control system allows the following functions to be performed:

the temperature of the water delivered to the tank may be selected and controlled on a load to load basis;

the total volume of water required for a given load may be selected. This volume may be delivered in fractions of the total, if required;

the temperature of the water in the hot water storage tank may be selected (to the nearest degree) up to maximum of 85 deg. Centigrade;

the heat exchanger or boiler is controlled by the computer which allows the heater to be turned on and off at any given pre-set time for each day of operation. On any given day additional heating outside the pre-set time may be obtained, if desired, and the volume of water required in the tank is programmable and the tank kept filled to this volume at the selected temperature, if required.

The size of the tank 1 and the capacity of the boiler 4 will be selected according to the size of the concrete batching plant. For example a small plant having an output of about 100 cubic meters per day will only require a 10,000 liter tank and a 400 MJ boiler while a large plant capable of continuous operation will require a 22,700 liter tank and a 1340 MJ boiler. Of course, if the requirement of a particular batching plant is that rapid recovery to the desired water temperature is required after an initial batch is prepared, a larger boiler will be used. For example the 1340 MJ boiler is capable of heating about 7,000 liters to 60° C. in one hour.

Figure 5A:
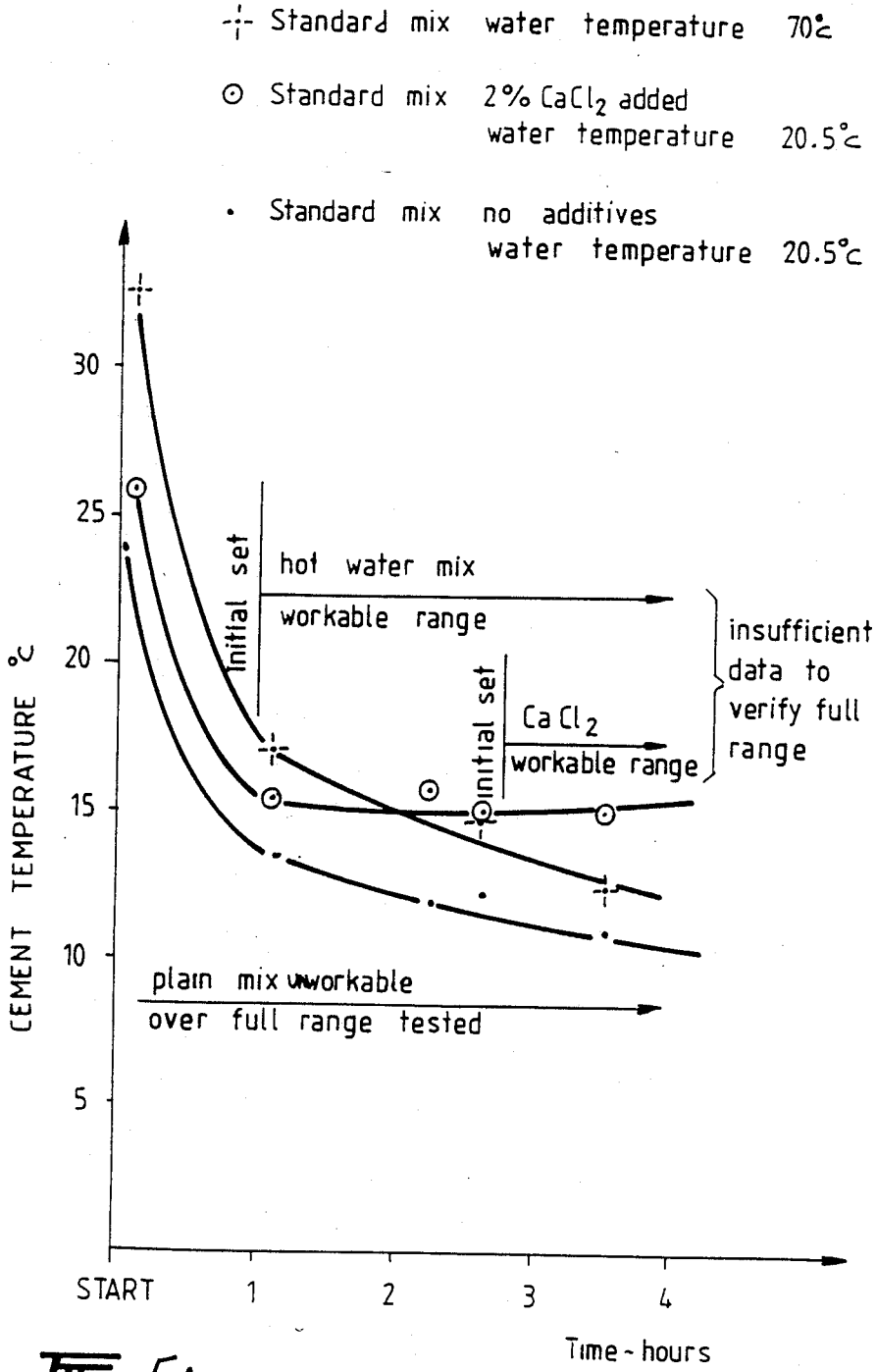
FIG. 5A is a graph showing the workability of cement at an ambient temperature of 8° C. and compares the use of hot water at 70° C. with water at 20.5° C. and a mixture containing 2% $CaCl_2$.

Referring to FIGS. 5A and 5B, it will be noted that chemical accelerators require approximately 2 to 3 hours to accelerate the cement mix to a point where it is workable and the workable range before the mixture becomes unworkable is limited to about 2 hours, depending of course on the ambient temperature. FIGS. 5A and 5B clearly show that the use of hot water at a temperature of 70° C. in the cement mix accelerates curing to a stage where the cement is workable but as the mix cools the curing process slows so that the cement mix is workable over a considerably longer period. A comparison of the graphs in FIGS. 5A and 5B shows that at an ambient temperature of 8° C., the hot water mix became workable after 1 hour, whereas the mix containing calcium chloride was not workable until near 3 hours has elapsed. The plain mix was unworkable over the full range tested. Where the ambient temperature was 22° C. (FIG. 5B), the hot water mix became workable after about 15 minutes whereas the calcium chloride mix was not workable until about 2 hours had elapsed and the plain water mix was not workable until approximately 4 hours had elapsed. Similarly, the workable range for the calcium chloride mix was approximately 2 hours whereas the hot water mix was workable for over 5 hours. The advantages to the builder of this shorter curing period and longer workable period are of course obvious.

Figure 6A:
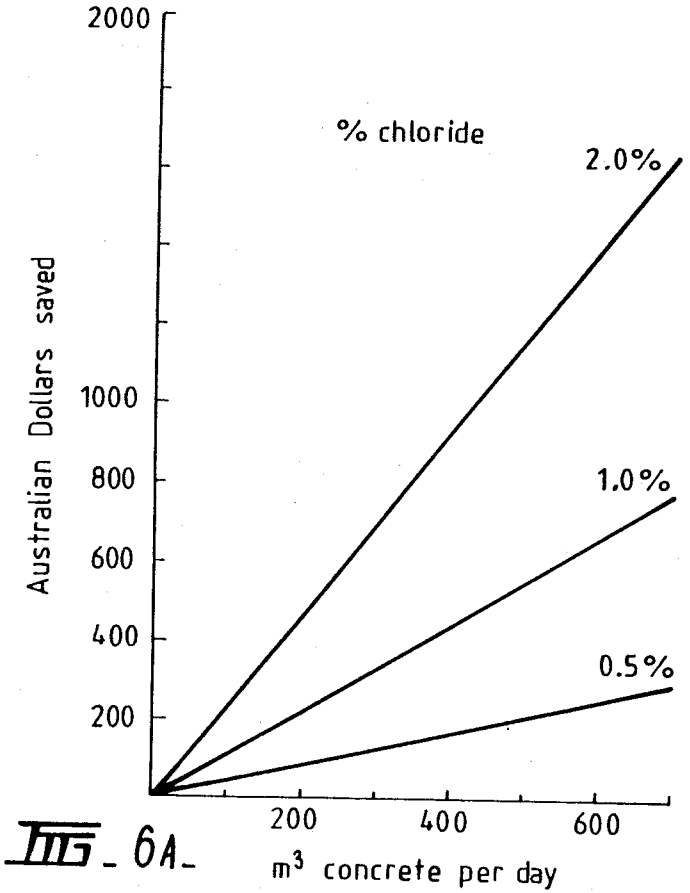
FIGS. 6A and 6B are graphs showing the cost savings using the liquid heating system of the present invention compared with the use of various percentages of calcium chloride as a curing accelerator and the use of various percentages of flyash for cement replacement.
Figure 6B:
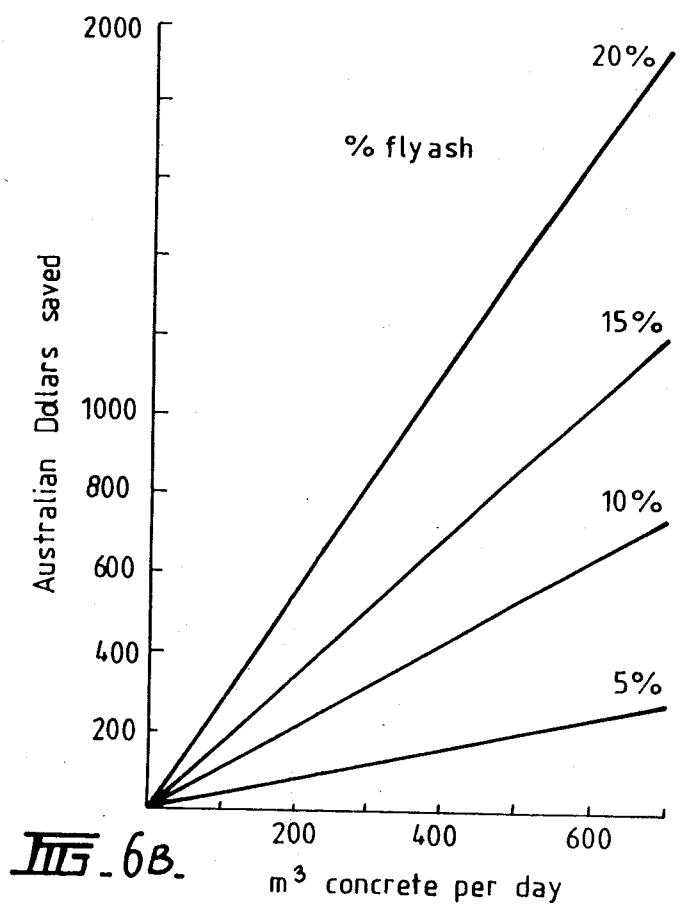

The economics of the use of hot water produced by the heating system of the present invention over various levels of calcium chloride, and the increased economic effectiveness of using flyash are obvious from the graphs of FIGS. 6A and 6B. A typical level of calcium chloride addition is 2% and it will be noted that when 400 cubic metres of concrete are being produced per day, a saving of A$1,000.00 is achieved. Significant savings are also achieved by the combined use of water heated by the heating system of the present invention in combination with various levels of flyash as a cement replacement. Since the use of water heated by the system according to the invention accelerates the curing process, a lower level of cement may be used without suffering valuable man hours due to delays in the curing process.

It follows from the above that the capital cost of a water heating system embodying the present invention, which is significantly lower than the capital cost of known water heating systems, may be recovered in a relatively short period of time. For example, for a relatively low daily concrete volume of 200 cubic metres, the capital recovery time from the savings achieved using the water heating system of the present invention would be less than 100 days. The capital recovery time may be further reduced by the use of flyash replacement in combination with the water heating system of the present invention.

Figure 7:
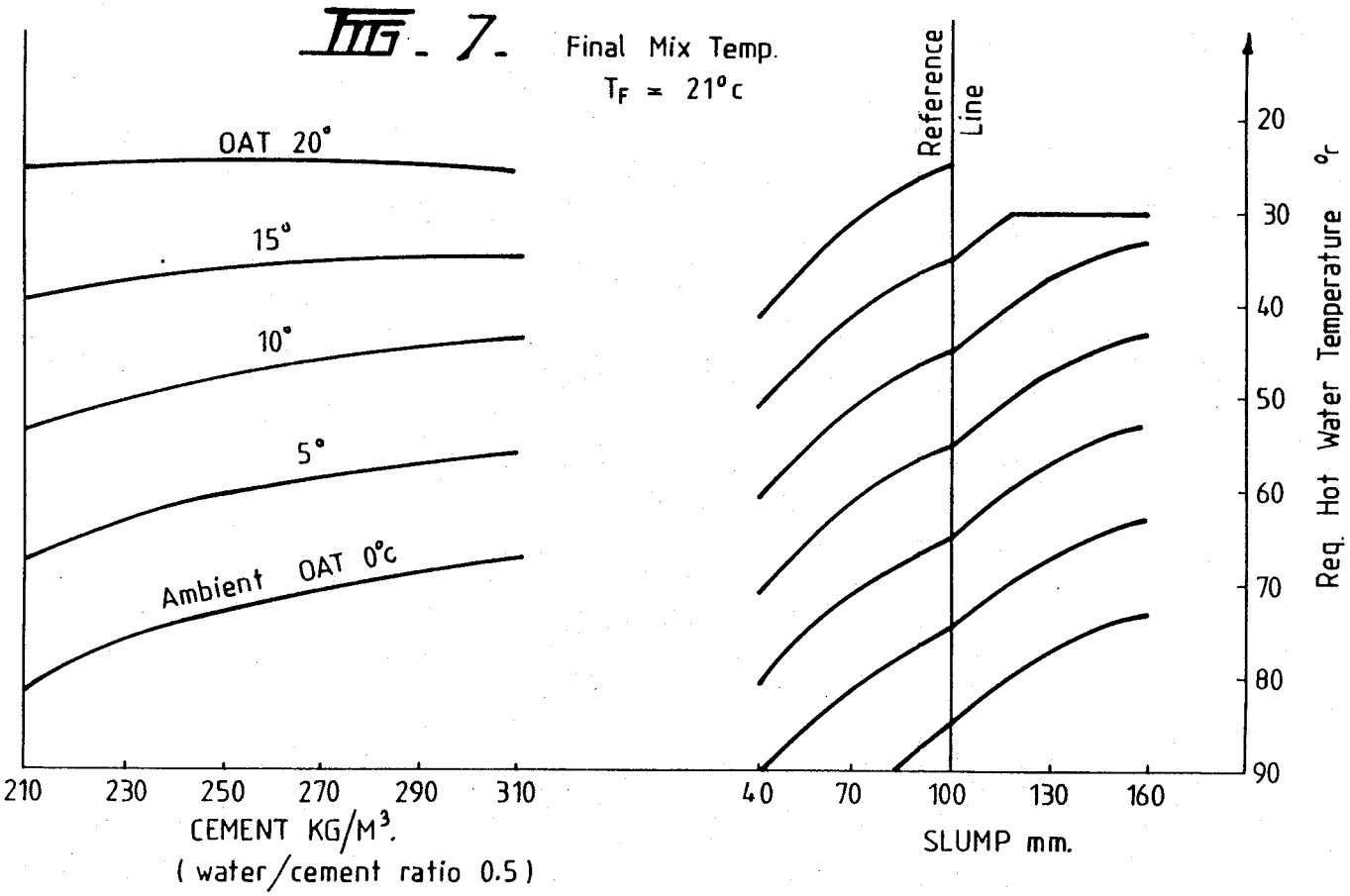
FIG. 7 shows a typical look up table for use with the control system for the liquid heating system to estimate the required temperature of the liquid to achieve a desired concrete mix temperature having regard to the ambient temperature and the quantity of cement used.

FIG. 7 shows a typical look up table which is used to calculate the required hot water temperature to achieve a final delivered water temperature, in the case of FIG. 7 21° C., in accordance with the ambient temperature indicated at the left side of the graph and desired slump of the cement mix.

To estimate the required water temperature, the operator notes the ambient temperature from the control panel display, and follows the temperature curve to the point of intersection with the vertical axis corresponding to the amount of cement in the mix. This point is then projected horizontally to the reference line and the closest curve is followed to the point of intersection with the desired slump line, and the temperature is then selected from the right vertical axis. For example for an ambient temperature of 10° C., a cement control of 250 $Kg/m^3$ and a desired slump of 70mm, the necessary temperature is 50° C.

While the system described above is manually programmed using the look up table, it will be appreciated that the computer 13 may be programmed with several look up tables providing the data necessary to achieve the most commonly desired final water temperatures, thereby requiring only the selection of the desired final mix temperature via the control panel, the computer calculating the necessary water temperature from the selected look-up table.

It will be appreciated from the above description that the water heating system embodying the present invention provides significant advantages to the manufacturers of cement mixes, as well as to the builder. These advantages include:

significant reduction of curing times;

curing times which are predictably linear whereby the workable period of the concrete is adequate;

enhancement of the existing cost advantages by the partial substitution of cement with flyash;

the removal of the corrosion problems caused by the use of chloride chemical accelerators, and the reduction of "bleeding".

The water heating system embodying the invention has the further general advantages of:

low capital cost;

low running cost;

provision for selecting optimum water temperature;

provision for using recycled water, and an efficiency which allows capital cost to be recouped in a short period of time.

Since the use of water heated by the system according to the invention accelerates curing in a natural manner, acting as a catalyst in the hydration process only, the strength of the resultant concrete is not affected by the use of hot water.

The low running cost of the system embodying the invention is achieved in part by the fact that the system heats only the amount of water required for a given concrete mixing batch. In the currently available water heating systems, large volumes of water are heated, with much of the hot water not subsequently being used.

The size of the tank 1 and the capacity of the boiler 4 will be selected according to the size of the concrete batching plant. For example a small plant having an output of about 100 cubic meters per day will only require a 10,000 litre tank and a 400 MJ boiler while a large plant capable of continuous operation will require a 22,700 liter tank and a 1340 MJ boiler. Of course, if the requirement of a particular batching plant is that rapid recovery to the desired water temperature is required after an initial batch is prepared, a large boiler will be used. For example the 1340 MJ boiler is capable of heating about 7,000 literes to 60° C. in one hour.

I claim:

1. In a concrete batching plant, a liquid heating system comprising a closed tank having low heat transfer properties for containing a volume of liquid to be heated, a heat exchanger having conduit means for carrying liquid connected by liquid carrying conduits to said tank, first pump means for transferring the heated liquid from the tank to a concrete batching plant, second pump means for circulating the liquid from the tank to the heat exchanger while the liquid is being heated by said heat exchanger, the capacity of said tank and the heating capacity of said heat exchanger being selected to enable the production of the desired volume of hot liquid required by the batching plant, and means for controlling the operation of the liquid heating system including means for determining and displaying the liquid volume in said tank, means for monitoring the volume of water delivered by said second pump means, means for sensing and displaying the temperature of the liquid in the tank, means for sensing and displaying the ambient temperature to enable determination of a predetermined temperature necessary to achieve a desired temperature in a concrete mix produced by said concrete batching plant, and programmable means for controlling said heat exchanger to heat said liquid to said predetermined temperature.

2. The system of claim 1, wherein said programmable means is programmed with data by means of which said predetermined temperature may be determined from said ambient temperature, the amount of cement in the concrete mix, and the desired slump of the concrete mix.

3. The system of claim 1, wherein said programmable means is programmable to cause said heat exchanger to commence operation at any predetermined time.

4. The system of claim 3, wherein said programmable means may be programmed with a desired volume of water in said tank, said control system being operative to maintain the volume of water in said tank at said desired volume.

5. The system of claim 1, wherein the liquid capacity of the tank and the heat output of the heat exchanger are selected from: for a small plant about 10,000 liters and about 400 MJ, for a medium plant about 23,000 liters and about 929 MJ, and for a large plant about 23,000 liters and about 1340 MJ.

6. A liquid heating system for use in concrete batching plants, comprising a closed tank having low heat transfer properties for containing a volume of liquid to be heated, a heat exchanger having conduit means for carrying liquid connected by liquid carrying conduits to said tank, first pump means for transferring the heated liquid from the tank to a concrete batching plant, second pump means for circulating the liquid from the tank to the heat exchanger while the liquid is being heated by said heat exchanger, the capacity of said tank and the heating capacity of said heat exchanger being selected to enable the production of the desired volume of hot liquid required by the batching plant, said closed tank includes an outer skin of concrete, an intermediate skin of plastics foam insulating material and an inner skin of concrete having a water resistant coating.

7. A liquid heating system for use in concrete batching plants, comprising a closed tank having low heat transfer properties for containing a volume of liquid to be heated, a heat exchanger having conduit means for carrying liquid connected by liquid carrying conduits to said tank, first pump means for transferring the heated liquid from the tank to a concrete batching plant, second pump means for circuiting the liquid from the tank to the heat exchanger, the capacity of said tank and the heating capacity of said heat exchanger being selected to enable the production of the desired volume of hot liquid required by the batching plant, said tank having an outer skin of concrete and an inner skin comprising mixture of vermiculite and cement.

8. A liquid heating system for use in concrete batching plants, comprising a closed tank having low heat transfer properties for containing a volume of liquid to be heated, a heat exchanger having conduit means for carrying liquid connected by liquid carrying conduits to said tank, first pump means for transferring the heated liquid from the tank to a concrete batching plant, second pump means for circulating the liquid from the tank to the heat exchanger while the liquid is being heated by said heat exchanger, the capacity of said tank and the heating capacity of said heat exchanger being selected to enable the production of the desired volume of hot liquid required by the batching plant, said tank has an inner skin comprising a mixture of vermiculite and cement, supported by a relatively thin metallic tank structure.

9. The system of claim 8, wherein said tank has an outer skin comprising a mixture of vermiculite and cement.

* * * * *